US006581580B2

(12) United States Patent
Trumpy et al.

(10) Patent No.: US 6,581,580 B2
(45) Date of Patent: Jun. 24, 2003

(54) HYDROCARBON VAPOR EVACUATION SYSTEM

(75) Inventors: David Karl Trumpy, Farmington Hills; Philip J Johnson, Ann Arbor, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/768,770

(22) Filed: Jan. 24, 2001

(65) Prior Publication Data

US 2002/0096148 A1 Jul. 25, 2002

(51) Int. Cl.[7] ..... F02M 33/02
(52) U.S. Cl. ..... 123/519; 123/516
(58) Field of Search ..... 123/520, 519, 123/518, 516, 198 D; 73/118.1

(56) References Cited

U.S. PATENT DOCUMENTS

RE26,169 E * 3/1967 Hall ..... 123/519
3,727,597 A 4/1973 Hensler
3,728,846 A * 4/1973 Nilsson ..... 55/159
4,085,721 A * 4/1978 Vardi et al. ..... 123/520
4,261,717 A 4/1981 Belore et al.
4,877,001 A * 10/1989 Kenealy et al. ..... 123/519
5,762,050 A 6/1998 Gonzalez
5,975,062 A 11/1999 Bonse et al.
6,014,958 A 1/2000 Miwa et al.

* cited by examiner

*Primary Examiner*—Willis R. Wolfe
*Assistant Examiner*—Mahmoud Gimie
(74) *Attorney, Agent, or Firm*—Carlos L. Hanze

(57) ABSTRACT

A vapor evacuation system that is used to intermittently remove hydrocarbon vapors from vehicle components to an available vapor storage canister using an electrically controlled small flow rate vapor-handling pump. The vapor-handling pump is intermittently turned on and off as a function of ambient temperature or inlet manifold temperature and as a function of time since last engine-on operation.

20 Claims, 3 Drawing Sheets

HYDROCARBON VAPOR EVACUATION SYSTEM

TECHNICAL FIELD

The present invention relates generally to vehicle systems and more particularly to a hydrocarbon vapor evacuation system.

BACKGROUND

Significant advances have been made in recent years in controlling the emission of hydrocarbon vapor from vehicle engines during engine-on conditions. However, a significant portion of the remaining hydrocarbon emissions from a vehicle occur after the vehicle engine is shut off. For example, hydrocarbon vapor may be produced within a vehicle's transmission, engine coolant reservoir, washer fluid reservoir, intake air induction system, or even a vehicle's passenger compartment during engine-off conditions.

Charcoal vapor canisters attached in series to a vehicle's fuel storage system are used to adsorb hydrocarbon vapor produced in the fuel storage system in engine-off conditions. However, these charcoal canisters typically are not coupled to other vehicle components that may emit vapor during engine-off cycles. As such, vapor emitted from these components may be released into the atmosphere.

It is thus highly desirable to couple a vapor storage system with these various vehicle components that emit hydrocarbon vapor in engine-off conditions to prevent the emission of hydrocarbon vapor to the atmosphere.

SUMMARY OF THE INVENTION

The above object is realized by providing a hydrocarbon vapor evacuation system that couples the hydrocarbon vapor emitting components with a hydrocarbon vapor canister. A small-flow rate gas-phase pump is operated intermittently whenever the engine is shut off.

The suction side of the pump has a manifold with vapor connections to any or all of the vehicle components that potentially emit hydrocarbon vapors during the engine-off period. The pressure side of the pump is directed to the vehicle vapor canister.

A small electric motor controlled by a stand alone controller drives the pump intermittently as a function of ambient temperature, time, or both ambient temperature and time. To save the vehicle battery, the duty cycle can be reduced to zero when the state of charge of the battery is determined to be too low to maintain long battery life.

Thus, hydrocarbon vapor generated within various vehicle components is pumped into a vapor canister, wherein it is adsorbed, to prevent the emission of the hydrocarbon vapor to the atmosphere. This allows vehicles having such a system to meet zero emission standards such as the California LEV-II requirement.

Other objects and advantages of the present invention will become apparent upon considering the following detailed description and appended claims, and upon reference to the accompanying drawings.

DESCRIPTION OF THE PREFERRED EMBODIMENT(S)

Figure 1:
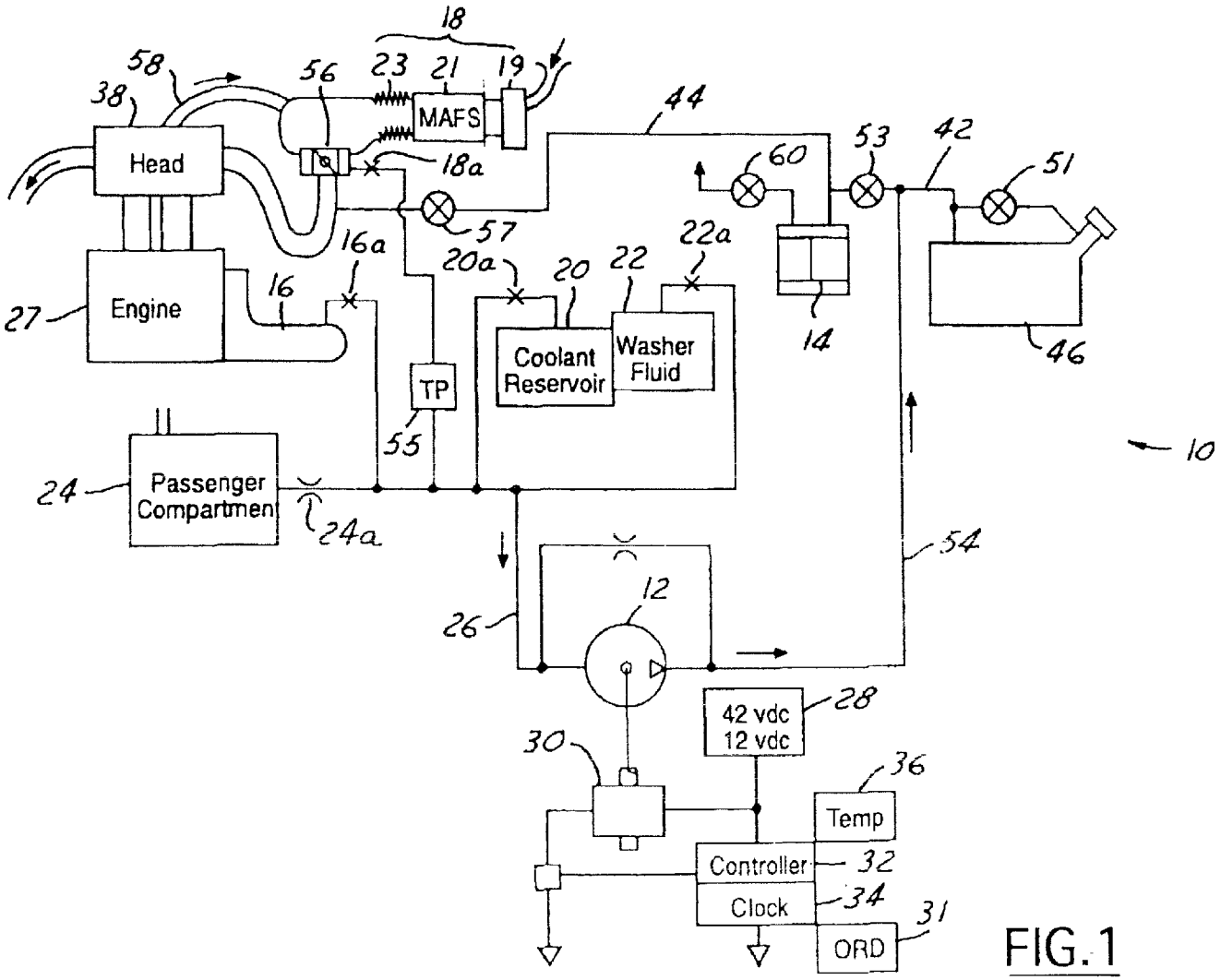
FIG. 1 depicts a hydrocarbon vapor evacuation system according to one preferred embodiment of the present invention.

Referring now to FIG. 1, a vapor evacuation system 10 is depicted in which a vapor-handling pump 12 is coupled in series between a vapor canister 14 and a variety of vehicle components, including a transmission 16, an air intake system 18, an engine coolant reservoir 20, a washer fluid reservoir 22, and a vehicle passenger compartment 24 by a series of plastic vapor lines 26 made of a very low hydrocarbon permeable material. In addition, a flow limiting orifice 16*a*, 18*a*, 20*a*, 22*a*, 24*a* is coupled between each vehicle or vehicle component 16, 18, 20, 22, 24 and the vapor-handling pump 12. The air intake system 18 generally consists of an air cleaner 19 coupled in series to a mass air-flow meter 21 and a series of zip tubes 23.

An electric motor 30 is coupled with the vapor-handling pump 12 and is used to drive the pump 12 during engine-off situations. A battery 28 provides power to drive the electric motor 30 during engine-off situations. Preferably, this battery 28 is a 42-volt vehicle battery. The control of the vapor evacuation system 10 during engine-off operations is discussed below in FIGS. 3 and 4.

While the embodiment as depicted in FIG. 1 shows five vehicle components 16, 18, 20, 22, 24 coupled to the pump 12, it is understood that one or more of these components may not be coupled to the system. For example, another variation of the present invention may not have the passenger compartment 24 coupled to the pump 12. In addition, it is contemplated that additional sources of hydrocarbon vapor generation during engine-off situations not shown here may be coupled with the pump 12 via additional plastic vapor lines 26.

The vapor-handling pump 12 is preferably a positive displacement type pump with an unrestricted flow capacity in the range of 1–5 cubic feet per minute. A gear pump or vane pump is preferred, although a small centrifugal pump may work as well.

Figure 2:
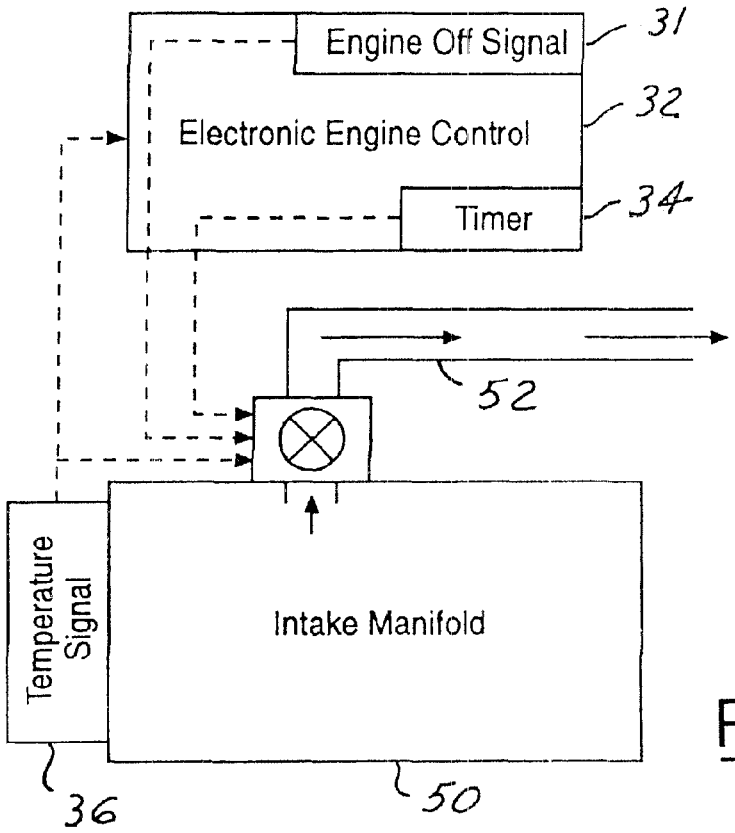
FIG. 2 is a detailed view of the vapor-handling pump and the stand-alone controller of FIG. 1.

As best seen in FIG. 2, the pump 12 has an inlet manifold 50 coupled to the plastic vapor line 26 and an exhaust manifold 52 coupled to a vapor line 54. A temperature sensor 36 is coupled to the inlet manifold 50 and can be configured to measure either inlet manifold temperature or ambient air temperature. The controller 32 is coupled to the pump 12 and receives temperature input from the temperature sensor 36 and also receives an engine-off signal from an engine sensor 31. A clock 34 is also coupled to the controller 32.

Referring again to FIG. 1, during engine-on vehicle operations, air enters the system 10 through a canister vent valve 60, purges any fuel vapor trapped within the canister 14, and proceeds to fuel line 44. Meanwhile, fuel vapor exits the fuel tank 46 through vent valve 51 via line 42 and through tank blocking valve 53 into fuel line 44. This air then combines with fuel vapor in line 44, travels through a production vapor management valve 57, and enters a cylinder head 38 of the engine 27 for combustion in a method well known in the art.

Immediately after engine shut-off, vent valve 51, canister vent valve 60, and production vapor management valve 57 are closed. The controller 32 then activates the electric motor 30 for a predetermined amount of time sufficient to remove hydrocarbon vapors from the various components to the vapor canister 14. These hydrocarbon vapors are generated in closed volume systems and open volume systems and are evacuated through the pump 12 to the vapor canister 14. The flow rate of air through the pump is controlled by the activation of the pump 12 by the controller 32 and the size of the pump 12. The methods are described in the following paragraphs.

Closed volume systems, such as the transmission 16, engine coolant reservoir 20, and washer fluid reservoir 22, are systems with only one connection to the atmosphere by way of the vapor-handling pump 12. Therefore, flow from these components will only be air and any excess vapor generated by high heat energy to these components 16, 20, 22. In closed volume systems, the air and hydrocarbon vapor travel from the components 16, 20, 22, through the respective orifice 16*a*, 20*a*, 22*a*, and into the plastic vapor lines 26. The vapor lines 26 are connected to the inlet manifold 50 of the vapor-handling pump 12. The air and vapor then exit through the exhaust manifold 52 into a vapor line 54, flow through tank blocking valve 53 and into the vapor canister 14. Hydrocarbon vapor is adsorbed by charcoal contained within the vapor canister 14 in a method well known in the art. Air passes out the vapor canister 14 and is released through the canister vent valve 60.

Open volume systems, such as the air intake system 18 and the passenger compartment 24, have at least one additional connection to the atmosphere other than through the vapor-handling pump 12. The flow through these open volume systems will be a steady flow, mostly of air, whenever the pump 12 is activated.

In the case of the air intake system 18, air will flow in from the atmosphere, through the air cleaner 19, the mass flow air meter 21, and the zip tubes 23. The air will then pass either through an open air throttle valve 56 or through the orifice 18*a*. Air that passes through the air throttle valve 56 continues into the cylinder head 38 to pick up excess hydrocarbon vapor. The flow will then proceed through a push-over tubing 58 and back into the air induction system 18. Air that flows through orifice 18*a* proceeds into the plastic vapor lines 26 connecting to the intake manifold 50. The air and vapor then exit through the exhaust manifold 52 into a vapor line 54, flow through tank blocking valve 53 and into the vapor canister 14. Air passes out the vapor canister 14 and is released through the canister vent valve 60.

For the passenger compartment 24, air flows in from the atmosphere, through orifice 24*a* and into the plastic vapor lines 26 connecting to the intake manifold 50. The air and vapor then exit through the exhaust manifold 52 into a vapor line 54, flow through tank blocking valve 53 and into the vapor canister 14. Air passes out the vapor canister 14 and is released through the canister vent valve 60.

A carbon trap 55 may also be coupled between the air intake system 18 and the vapor-handling pump 12 is an alternative arrangement to adsorb hydrocarbon vapor generated by the air induction system 18. This carbon trap 55 would be purged with reverse air flowing when the engine 27 is operating.

Figure 3:
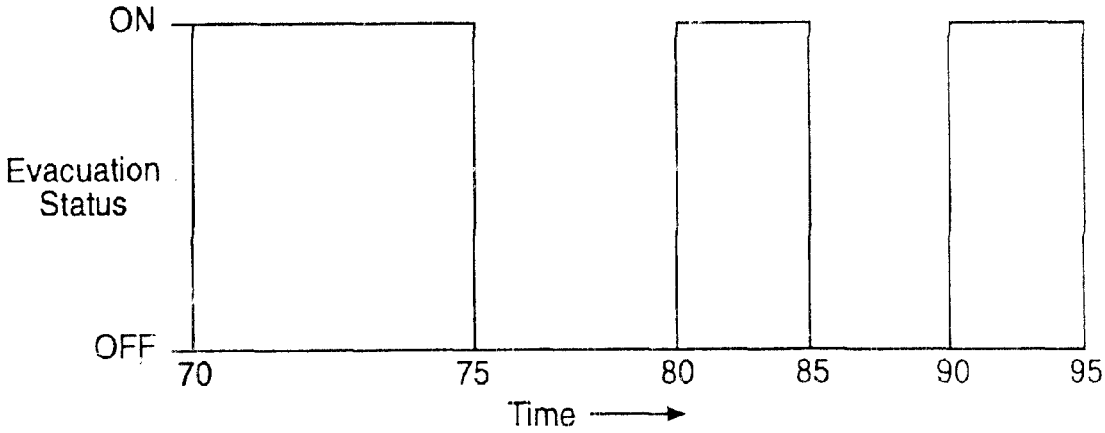
FIG. 3 depicts the main cycling mode for the pump of FIG. 1.
Figure 4:
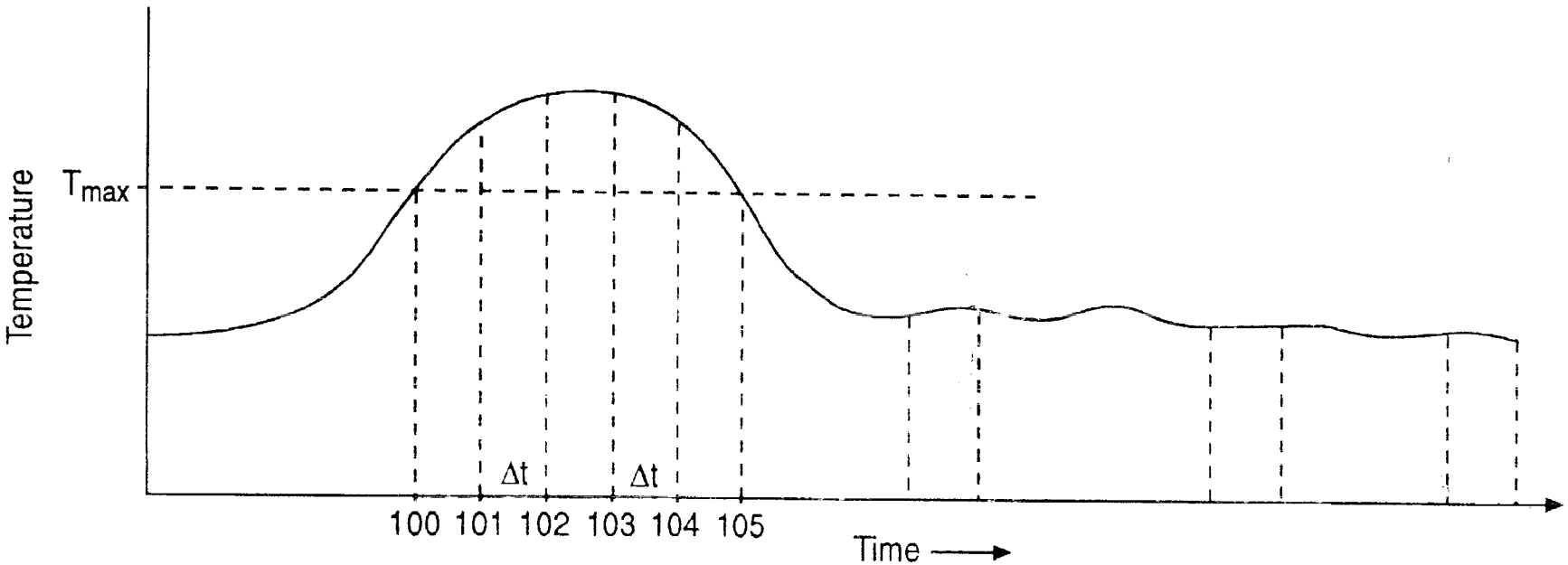
FIG. 4 depicts a temperature dependent cycling mode for the pump of FIG. 1.

The cycling on and off of the vapor evacuation system 10 uses two separate, yet interrelated, control systems. The first, as described in FIG. 3, is the main cycling mode during engine-off conditions. The second, depicted in FIG. 4, shows control of the vapor evacuation system 10 during a transient temperature period.

Referring now to FIG. 3, the main cycling mode of the vapor evacuation system 10 during engine shutoff conditions is depicted. Immediately after engine shutoff, the controller 32 directs the electric motor on for a predetermined length of time, depicted between times 70 and 75. The clock 34 coupled to the controller 32 is monitored by the controller 32 to maintain the duty cycle. The predetermined length of time between times 70 and 75 is sufficient to remove hydrocarbon vapors to the vapor canister 14 and is determined by factoring in many characteristics of the vapor evacuation system 10. These factors include, but are not limited to, the size of the engine 27, the cooling rate of the engine 27, the size and flow rate of the vapor-handling pump 12, and the size of the battery 28.

Between times 75 and 80, the controller 32 directs the electric motor 30 and vapor-handling pump 12 to be turned off. From time 80 to time 85, the pump 12 is once again turned on for a predetermined period based on the size and flow rate of the vapor-handling pump 12. The controller 32 also senses the state of charge for the battery 28. The on/off cycling continues until the engine 27 is restarted. After a 3–5 day period of engine-off condition, the pump 12 duty cycle may be decreased. At any point during the cycle, the controller 32 may choose not to activate the electric motor 26 if the state of charge of the battery 28 is below a predetermined state of charge.

The controller 32 also monitors inlet manifold 50 temperature during engine-off cycles using the temperature sensor 36. Alternatively, the temperature sensor 36 could be directed to read ambient air temperature. Whenever the temperature exceeds a predetermined maximum level sufficient to cause the generation of hydrocarbon vapors, a second engine-off mode, the temperature excursion mode, is activated.

As seen in FIG. 4, as temperature exceeds a predetermined maximum temperature ("Tmax") at time 100, the controller 32 directs the electric motor 26 on to drive the vapor-handling pump 12 for a predetermined period. At time 101, the controller 32 directs the pump 12 off. This cycling continues while inlet manifold temperature or ambient temperature is above Tmax, herein depicted between times 102 and 103 as well as between times 104 and 105. When the inlet manifold temperature or ambient temperature is below the predetermined maximum level Tmax, here at time 105, the cycling is then returned to the main duty cycle as depicted in FIG. 3 until the engine 27 is restarted. Again, as in FIG. 3, the controller 32 may choose not to activate the electric motor 26 if the state of charge of the battery 28 is below a predetermined state of charge.

In an alternative arrangement, the controller 32 may direct the electric motor 26 to remain on until such time as the ambient air temperature or inlet manifold temperature falls below the predetermined maximum temperature level Tmax.

The present invention offers a method for limiting hydrocarbon vapor emission from vehicle components during engine-off cycles. The vapor evacuation system 10 is designed to prevent hydrocarbon vapor release into the atmosphere by intermittently evacuating the vapor from the vehicle components during engine-off cycles. Studies indicate that the present invention is expected to prevent the release of 95–99% of hydrocarbon vapors in the hydrocarbon vapor evacuation system 10. Further, the potential release of hydrocarbon vapors for a three-day diurnal event from the transmission 16 or engine coolant reservoir 20 is estimated to be less than five milligrams. The present invention is estimated to meet current requirements of zero evaporation, which is defined as less than forty-five milligrams of hydrocarbon vapor emission per three-day diurnal cycle with a maximum ambient temperature of one hundred five degrees Fahrenheit.

While the invention has been described in terms of preferred embodiments, it will be understood, of course, that the invention is not limited thereto since modifications may be made by those skilled in the art, particularly in light of the foregoing teachings.

What is claimed is:

1. A hydrocarbon vapor evacuation system comprising:

a vehicle component;

a vapor-retaining device;

a vapor-handling pump coupled between said vehicle component and said vapor-retaining device for removing hydrocarbon emissions from said vehicle component to said vapor-retaining device when driven;

an electric motor coupled to said vapor-handling pump capable of driving said vapor-handling pump when activated;

a battery coupled to said electric motor, said battery used to power said electric motor during engine-off conditions; and a controller coupled to said electric motor and said battery for activating said electric motor during engine-off conditions when a state of charge of said battery is at or above a predetermined state of charge.

2. The hydrocarbon vapor evacuation system of claim 1, wherein said vehicle component is selected from the group consisting of a transmission, an intake air induction system, an engine coolant reservoir, a washer fluid reservoir, and a passenger compartment.

3. The hydrocarbon vapor evacuation system of claim 1, wherein said controller activates said electric motor for a first predetermined amount of time immediately after engine shutoff.

4. The hydrocarbon vapor evacuation system of claim 3, wherein said controller intermittently activates said electric motor for a predetermined amount of time subsequent to said first predetermined amount of time when a first operating condition occurs.

5. The hydrocarbon vapor evacuation system of claim 4, wherein said first operating condition is selected from the group consisting of a first amount of time elapsed since said electric motor was last activated, an ambient temperature level exceeding a predetermined maximum ambient temperature level and an inlet manifold temperature level exceeding a predetermined maximum inlet manifold temperature level.

6. The hydrocarbon vapor evacuation system of claim 1, wherein said controller deactivates said electric motor when a state of charge of a battery for powering said electric motor is below a predetermined state of charge.

7. The hydrocarbon vapor evacuation system of claim 3, wherein said electric motor is activated as a function of an inlet manifold temperature.

8. The hydrocarbon vapor evacuation system of claim 3, wherein said electric motor is activated as a function of an ambient air temperature.

9. The hydrocarbon vapor evacuation system of claim 1, wherein said vapor-handling pump is a small flow rate positive displacement pump having a flow rate capacity in the range of one to five cubic feet per minute.

10. The hydrocarbon vapor evacuation system of claim 1, wherein said vapor-retaining device comprises a vapor canister.

11. A method for limiting hydrocarbon vapor emission from a vehicle during an engine-off condition comprising the steps of:

coupling a vapor-handling pump between at least one vehicle component and a vapor-retaining device;

coupling an electric motor to said vapor-handling pump;

coupling a battery to said electric motor, said battery capable of powering said electric motor in the engine-off condition;

coupling a controller to said electric motor and said battery, said controller capable of activating said electric motor to drive said vapor-handling pump to remove hydrocarbon emissions from said at least one vehicle component; and activating said electric motor to drive said vapor-handling pump to remove hydrocarbon emissions from said at least one vehicle component to said vapor-retaining device in response to an operating condition when a state of charge of said battery is at or above a predetermined state of charge.

12. The method of claim 11, wherein the step of coupling a vapor-handling pump comprises the step of a vapor-handling pump between at least one vehicle component and a vapor retaining device, wherein said at least one vehicle component is selected from the group consisting of a transmission, an intake air induction system, an engine coolant reservoir, a washer fluid reservoir, and a passenger compartment.

13. The method of claim 11, wherein the step of activating said electric motor comprises the steps of:

activating said electric motor for a predetermined amount of time in response to an engine shut-off command; and subsequently activating said electric motor for a second amount of time in response to an operating condition.

14. The method of claim 13, wherein the step of subsequently activating said electric motor comprises the step of subsequently activating said electric motor for a second amount of time when a third predetermined amount of time has passed since said electric motor was last activated.

15. The method of claim 13, wherein the step of subsequently activating said electric motor comprises the step of subsequently activating said electric motor when an inlet manifold temperature exceeds a predetermined maximum inlet manifold temperature.

16. The method of claim 15 further comprising the step of deactivating said electric motor when said temperature of said inlet manifold falls below said predetermined maximum temperature.

17. In a vehicle evacuation system having an electric motor driven vapor-handling pump coupled between vehicle component and a vapor storage canister during an engine shut off condition, a method for controlling the evacuation of hydrocarbon vapors from the vehicle component comprising the steps of:

(a) activating the electric motor to drive the vapor-handling pump for a predetermined amount of time in response to an engine shut-off signal; thereafter (b) intermittently activating the electric motor to drive the vapor-handling pump for a predetermined time interval; and (c) intermittently activating the electric motor to drive the vapor-handling pump for a second predetermined time interval when a temperature level exceeds a predetermined maximum level wherein the activation of the electric motor in steps (a), (b), and (c) can only occur when a state of charge of a battery used to power the electric motor is at or above a predetermined state of charge.

18. The method of claim 17, wherein said temperature level is an ambient temperature level.

19. The method of claim 17, wherein said temperature level is an inlet manifold temperature level.

20. The method of claim 17 further comprising the step of deactivating said electric motor when said temperature level falls below said predetermined maximum level.

* * * * *